United States Patent [19]

Pavlik

[11] 4,131,987

[45] Jan. 2, 1979

[54] METHOD OF PRODUCING A MICROWAVE FILTER COMPRISING A BODY OF GYROMAGNETIC MATERIAL AND A SOURCE OF A PREPOLARIZING MAGNETIC FIELD WHOSE RESONANT FREQUENCY IS A PREDETERMINED FUNCTION OF THE TEMPERATURE

[75] Inventor: Klaus J. Pavlik, Eindhoven, Netherlands

[73] Assignee: U.S. Philips Corporation, New York, N.Y.

[21] Appl. No.: 810,667

[22] Filed: Jun. 28, 1977

[30] Foreign Application Priority Data

Aug. 2, 1976 [NL] Netherlands ..... 7608560

[51] Int. Cl.[2] ..... H01P 11/00

[52] U.S. Cl. ..... 29/593; 29/602 R; 333/73 R

[58] Field of Search ..... 29/593, 592, 602 R; 333/73 R, 73 S, 73 C, 73 W

[56] References Cited

U.S. PATENT DOCUMENTS

| | | | |
|---|---|---|---|
| 3,426,297 | 2/1969 | Cohen | 333/73 R |
| 3,504,305 | 3/1970 | Cohen | 333/73 R |
| 3,648,199 | 3/1972 | Buck et al. | 333/73 R |
| 3,713,210 | 1/1973 | Schellenberg | 29/593 |
| 3,740,675 | 6/1973 | Moore et al. | 333/73 R |
| 3,801,936 | 4/1974 | Roschbaum | 333/73 C |

*Primary Examiner*—C.W. Lanham
*Assistant Examiner*—Daniel C. Crane
*Attorney, Agent, or Firm*—Thomas A. Briody; David R. Treacy; Algy Tamoshunas

[57] ABSTRACT

A method of producing a microwave filter using a YIG sphere whose resonant frequency is a predetermined function of the temperature is disclosed comprising the steps of introducing a reference YIG sphere with a predetermined orientation into the filter structure and changing the external magnetic field until the resonant frequency is adjusted to a predetermined value. Thereafter another YIG sphere is introduced into the resonator structure and rotated until the resonant frequency is again equal to the predetermined value, whereupon the YIG sphere is locked in position.

1 Claim, No Drawings

METHOD OF PRODUCING A MICROWAVE FILTER COMPRISING A BODY OF GYROMAGNETIC MATERIAL AND A SOURCE OF A PREPOLARIZING MAGNETIC FIELD WHOSE RESONANT FREQUENCY IS A PREDETERMINED FUNCTION OF THE TEMPERATURE

BACKGROUND OF THE INVENTION (1) Field of the Invention

The invention relates to a method of producing a microwave filter which comprises a body of gyromagnetic material and a source of a pre-polarizing magnetic field whose resonant frequency is a predetermined function of the temperature.

Such filters provided with one or more spheres of a gyromagnetic material such as yttrium iron garnet (YIG) are used in the microwave devices for realizing bandpass and bandstop filters having a high Q-factor.

(2) Description of the Prior Art

U.S. Pat. No. 3,713,210 issued on January 30th, 1973 to James M. Schellenberg discloses a method of stabilizing the resonant frequency of a YIG filter having a permanent magnet which acts as a source of the pre-polarizing magnetic field.

In accordance with this method, a YIG sphere is disposed in the field of a permanent magnet and the change in the resonant frequency across a given temperature range is measured.

With this data and the knowledge of the variation of the anisotropic field with temperature a correctional resonant frequency $f_b$ is calculated such that the change of the prepolarizing magnetic field with temperature is eliminated by the change with temperature of the anisotropic field.

This correctional resonant frequency can be expressed as:

$$f_b = f_{a1} - \frac{\Delta f_a}{1 - \frac{Ha2}{Ha1}} \quad (1)$$

In this expression $f_{a1}$ is the resonant frequency at the temperature $T_1$, $\Delta f_a$ is the change in the resonant frequency when the temperature changes from $T_1$ to $T_2$, and Ha1 and Ha2 are the values of the anisotropic field at temperature $T_1$ and $T_2$, respectively.

The following numerical example illustrates an extreme case starts from an YIG filter having a permanent magnet consisting of an aluminium-nickel-cobalt alloy having a high Curie point.

At a given temperature range of, for example, 20°–65° C., the change $\Delta H_a$ in the anisotropic field may be approximately 20 Oersted (Ha1 = 45 Oersted, Ha2 = 25 Oersted) and the change ΔHo of the field of the permanent magnet may amount to approximately 4 Oersted. The change $\Delta f_a$ in the resonant frequency which occurs may be 120 MHz depending on the orientation of the field of the permanent magnet in the crystal lattice of the YIG sphere. The second term in the right hand portion of the equation (1) may then become 275 MHz.

The correctional resonant frequency may thus deviate considerably from the initiated adjusted resonant frequency $f_{a1}$. This renders it imperative to make several adjustments to obtain a temperature stabilisation at a predetermined resonant frequency.

SUMMARY OF THE INVENTION

It is an object of the invention to provide a simple method for simultaneously adjusting the resonant frequency to a predetermined value and to give a predetermined value to the change in the resonant frequency with temperature.

The method according to the invention is therefore characterized in that a body of a gyromagnetic material, called a reference body, is introduced into the filter structure with a predetermined orientation relative to the pre-polarizing magnetic field. Thereafter, by changing the magnetic field, the resonant frequency is adjusted to a predetermined value, and the reference body is removed from the filter structure. One other body of gyromagnetic material of the same dimensions and composition as the reference body is then inserted into the filter structure and the orientation of this body is changed until the resonant frequency is equal to the above-mentioned predetermined resonant frequency and the body is fixed in that position.

DESCRIPTION OF THE METHOD

The object of the method is to fabricate YIG filters having a predetermined resonant frequency $f_o$ and a predetermined temperature dependency:

$$\frac{\Delta f_O}{\Delta T}$$

of the resonant frequency.

For that purpose the starting point is a set of identical filter structures whose magnetic fields have the same temperature coefficient. This can be realized by means of permanent magnets consisting of an aluminium-nickel-cobalt allow having a high Curie point.

By means of a suitable mounting of the components it is ensured that the YIG spheres in the resonators have the same environment.

The YIG spheres which are used for the filters must be identical as regards the diameter and the composition of the material (the same saturation magnetisation and anisotropic field).

By trial and error, a YIG sphere is oriented in one of the filters to simultaneously obtain the desired $f_o$ and $$\frac{\Delta f_o}{\Delta T}.$$

The orientation of this YIG sphere relative to the pre-polarizing magnetic field of the filter is noted.

The YIG sphere may be introduced into the filter structure, for example, by securing the sphere to one end of a dielectric rod. The orientation of the YIG sphere can be changed by rotating the rod and its orientation noted by applying marks on the rod and the filter structure.

The reference YIG sphere found in this manner is now introduced with the predetermined orientation into another filter structure. The resonant frequency thereof is measured and the desired $f_o$ is adjusted by changing the magnetic field. In the further course of the method the magnetic field is retained at the adjusted value.

Thereafter the reference YIG sphere is replaced by another identical YIG sphere. The resonant frequency is measured and the desired $f_o$ is adjusted by changing the orientation of the YIG sphere, whereupon the YIG sphere is locked in position. The YIG filter thus obtained has the same $f_o$ and $$\frac{\Delta f_o}{\Delta T}$$

as the filter with the reference YIG sphere.

The method described may be used independently of the nature of the source of the pre-polarizing magnetic field. The method thus can be used with either a permenant magnet or an electromagnet which is fed by an energizing current.

The reference YIG sphere can be used repeatedly for producing a series of identical YIG filters. One reference YIG sphere is actually sufficient for an unlimited series of YIG filters.

The change in the resonant frequency versus the temperature $$\frac{\Delta f_o}{\Delta T}$$

may have, within the framework of the physical possiblities, any desired value and is not limited to the value zero which would mean that the resonant frequency is independent of the temperature. Other values than zero may be desired when the center frequency of the filter must just be able to follow another frequency which changes with temperature.

What is claimed is:

1. A method of fabricating a microwave filter with a resonant frequency which is a predetermined function of temperature, said filter having a gyromagnetic element and a source of a pre-polarizing magnetic field, said method comprising the steps of inserting into the filter structure a reference gyromagnetic element with a predetermined orientation relative to said magnetic field, adjusting the resonant frequency of the filter to a predetermined value by changing the magnetic field, removing said reference element from the filter structure, inserting into the filter structure a second gyromagnetic element of the same dimensions and composition as said reference element, adjusting the orientation of said second element until the resonant frequency of the filter is equal to said predetermined resonant frequency and locking said second element in that position.

* * * * *